United States Patent [19]

Rose

[11] 4,254,685

[45] Mar. 10, 1981

[54] DRUM AND DRUMHEAD STRUCTURE

[76] Inventor: Calvin D. Rose, 68 Highview Ave., Stamford, Conn. 06907

[21] Appl. No.: 48,231

[22] Filed: Jun. 13, 1979

[51] Int. Cl.[3] ..... G10D 13/02

[52] U.S. Cl. ..... 84/414; 84/411 R; D17/22

[58] Field of Search ..... 84/411–420; D17/22

[56] References Cited

U.S. PATENT DOCUMENTS

| | | | |
|---|---|---|---|
| 2,018,182 | 10/1935 | Logan | 84/414 |
| 3,425,309 | 2/1969 | Elzas et al. | 84/414 |
| 3,668,296 | 6/1972 | Criscuolo | 84/414 |

*Primary Examiner*—Lawrence R. Franklin

*Attorney, Agent, or Firm*—Merriam, Marshall & Bicknell

[57] ABSTRACT

A drumhead adapted for mounting on a musicians drum comprising a compound drumhead membrane of durable flexible stretch-resistant material having a center portion of predetermined thickness in an outer portion having a greater thickness than said center portion which provides an inexpensive way of producing a desirable large momentary increase in the pitch of a drum when the drum is struck a sharp blow with a drum stick and at the same time effecting a significant decrease in the decay time of the fundamental tone of the drum.

38 Claims, 9 Drawing Figures

DRUM AND DRUMHEAD STRUCTURE

The present invention relates generally to a drum structure and more particularly to an improved drumhead for producing momentarily a large change in the fundamental pitch of a drum when the drum is struck a sharp blow; thereby adding interest and color to the usual rhythmic role of a drum.

The playing characteristics of a drum which a drummer desires depends on the musical style of the drummer and on the type of music played. Various means are presently employed to affect the playing characteristics of a drum, such as a tom-tom type drum, and modify the modes thereof. Normally, equal tension is applied to the drumhead in all directions. When the tension is uneven beats are heard when the drum is struck. If it is desired to shorten the decay time of the drum modes and give the drum a dull tone quality, dampening means are used, such as attaching a piece of cloth to the drum membrane or taping a small patch of cloth or plastic foam to the drumhead membrane. Other means are used for increasing the amount of pitch change produced when the drum is struck a sharp blow. For example, loosening one of the tuning screws to effect a change in the pitch is one expedient used, however, the drum then does not hold its tuning very well. Another procedure is to adhesively secure to the center of the drumhead, a dot or small patch of flexible plastic material which gives the drumhead a "tubby" sound and tends to increase the decay time of the fundamental mode while causing the fundamental mode to have a change in frequency as a function of the displacement thereof. Electronic means have also been used to produce a simulation of a pitch change, but such means are expensive and not practical for many to use.

The present invention provides an inexpensive way of effecting a desirable large momentary increase in the pitch of a drum when the drum is struck a sharp blow and at the same time effecting a significant decrease in the decay time of the fundamental tone or mode of a drum and will be apparent from the following detailed descriptions and claims to follow when read in conjunction with the accompanying drawing, wherein:

Figure 1:
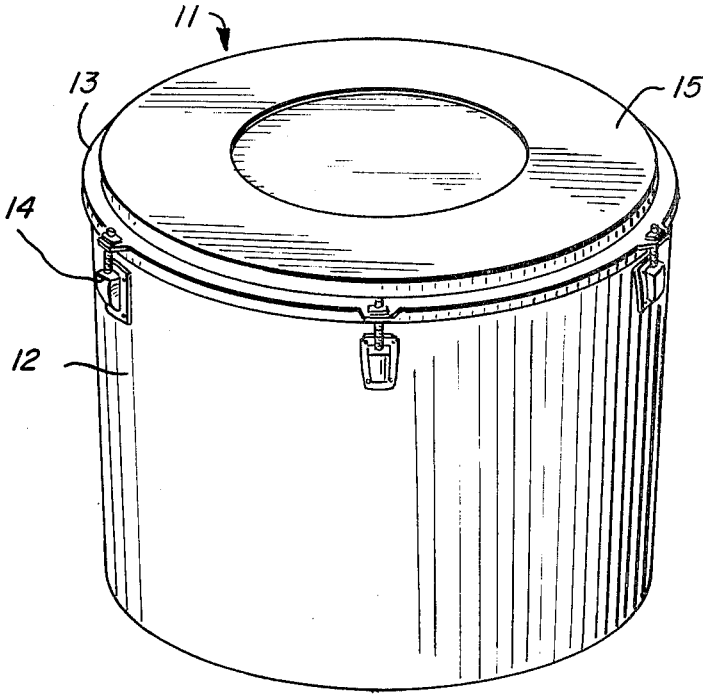
FIG. 1 is a perspective schematic view of a drum having a compound drumhead of the present invention mounted on one end thereof.
Figure 2:
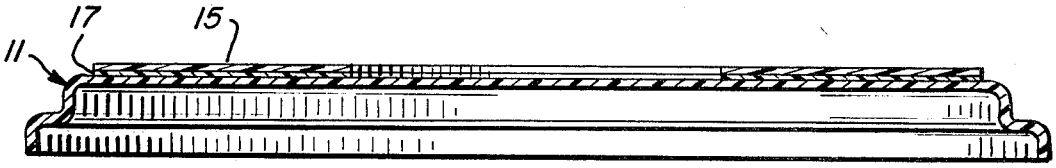
FIG. 2 is a schematic vertical sectional view of the drumhead of FIG. 1.

The improved drum structure in accordance with a preferred embodiment of the present invention comprises a drum with a generally cylindrical body having mounted on at least one end thereof a compound drumhead which in the form shown in FIGS. 1 and 2 comprises a conventional flexible, stretch-resistant uniform drumhead membrane adapted for mounting on one end of a drum and having integrally secured to one surface of the drumhead membrane a ring-like section to provide a drumhead having an inner center section or portion of substantially uniform thickness providing an area adapted to be struck by drum sticks during play of the drum and an outer section or portion of increased thickness extending from the center portion outwardly, preferably to the outer edge of the drumhead. The outer ring-like section or portion of increased thickness is preferably formed of the same flexible, stretch-resistant material as the uniform drumhead membrane and is securely affixed to the uniform drumhead membrane by a thin, flexible layer of adhesive material to provide a unitary compound drumhead structure. The uniform outer ring-like portion has a width less than the radius of the drumhead and provides a drumhead with an outer section of increased thickness and a central area of substantial uniform thickness which is thinner than the remainder of the drumhead and sufficiently large to be struck with drum sticks during play.

If desired, a compound drumhead embodying the present invention having a relatively thinner inner center section or portion and a relatively thicker outer section or portion extending radially outwardly therefrom can be formed as a unitary, homogenous structure by molding the drumhead membrane of a suitable plastic material which is durable, flexible and stretch-resistant to provide the center section having a substantial uniform thickness and thicker outer ring-like section surrounding the center section which also has a substantially uniform thickness. A drumhead having the improved features of the present invention can also be made by forming the outer ring-like section on a conventional drumhead membrane as a liquid coating which on drying forms the outer ring-like section and effects an increase in the average thickness of the drumhead membrane. A uniform liquid film can be applied to the outer portion of the drumhead membrane, such as by spraying or flowing a liquid flowable plastic material onto a template or by painting. When the liquid plastic material dries, it forms a uniform adherent, durable, stretch-resistant section securely attached to the membrane around the central area of the drumhead.

A preferred embodiment of the present invention is shown in FIGS. 1–2 of the drawing wherein a drum 10 has a generally circular drumhead 11 of substantially uniform thickness formed of durable, flexible drumhead material which is resistant to stretching when struck with a drum stick, such as Mylar plastic drumhead material, mounted on at least one end of the generally cylindrical body section 12 of the drum with the outer edges of the drumhead membrane held in a conventional fitting 13 provided with tension adjusting screws 14 which exerts the desired degree of tensioning on the drumhead membrane 11. Secured to the outer surface of the drumhead 11 is a ring-like member 15 formed of a flexible material resistant to stretching, such as Mylar plastic or metalized Mylar plastic in sheet form (Mylar is a trademark of E. I. duPont deNemours & Co. and is formed of polyethylene terephthalate resin) or similar material, which preferably has a uniform thickness of the same order of magnitude as the drumhead membrane 11 and having a width about half the radius of the drumhead extending inwardly from the outer edge of the drumhead membrane 11. The ring member 15 is secured to the outer surface of the drumhead by a layer of flexible adhesive 17, such as contact cement, so as to securely affix the ring member 15 to the surface of the drumhead 11 and form a unitary structure.

Depending on the size of the drum is a typical ring-like member 15 can have a width ranging from about 0.152 m to 0.660 m (6 inches to 26 inches), a thickness between about 0.0001 m to 0.0005 m 0.005 inches to 0.02 inches) and a width less than half the diameter of the drumhead so that the drum can be played in the usual manner without striking the ring-like member.

Figure 3:
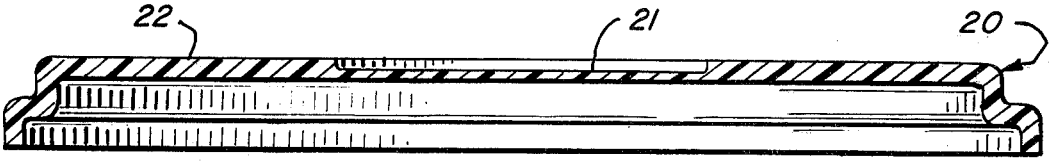
FIG. 3 is a schematic vertical sectional view of a modified form of the drumhead invention of the present invention.

FIG. 3 of the drawing shows a modified form of the improved drumhead structure in which the compound membrane 20 forming the drumhead is a unitary, homogenous structure formed by molding or casting a plastic drumhead material, such as Mylar, so as to form an inner generally circular section 21 having a uniform or substantially uniform thickness and an outer ring-like section 22 having a substantially uniform thickness greater than the thickness of the inner section 21.

Figure 4:
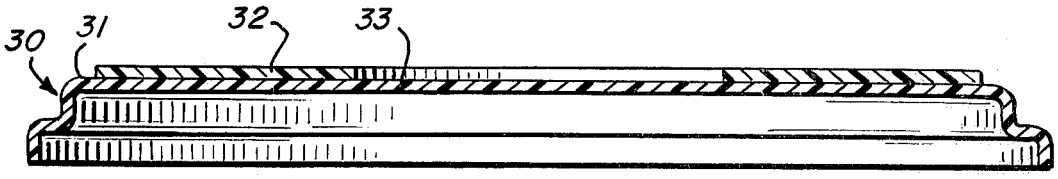
FIG. 4 is a schematic vertical sectional view of a further modified form of the drumhead invention of the present invention.

FIG. 4 shows a further modified form of the invention in which the compound drumhead membrane 30 is formed of a uniformly thick drumhead membrane 31 which has a ring-like member 32 formed on the outer surface thereof which extends inwardly toward a uniformly thin generally circular area 33. The outer ring-like section is formed by applying a layer of liquified drumhead material which when solidified forms a unitary flexible stretch-resistant section of substantially uniform thickness affixed to the surface of the membrane 31 without requiring the use of an adhesive layer to securely attach the ring member to the drumhead membrane 31.

Figure 5:
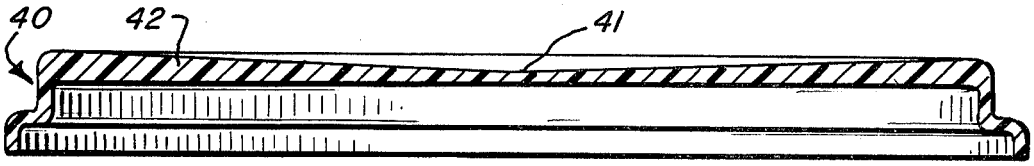
FIG. 5 is a schematic vertical sectional view of a still further modified form of the drumhead invention of the present invention.

As a further modified form of the present invention, the so-called compound drumhead can have the configuration shown in FIG. 5 wherein the drumhead 40 is thinnest at the center 41 and progressively increases in thickness as the distance from the center increases, as at 42. If desired, the center thin portion can be widened to form a thin circular portion, at the center of the drumhead as in FIGS. 1 and 2 of the drawing with the outer ring-like portion increasing progressively in thickness as the distance from the center circular portion increases.

EXAMPLE

As a specific illustration of the present invention, a Ludwig tom-tom having a cylindrical main body section 13 inches in diameter was provided with a simple uniformly thick metalized Mylar drumhead membrane for mounting on one end of the tom-tom. The physical consistence of the drumhead membrane were as follows:

$2.41\times10^{-4}$ m = thickness
0.165 m = radius
$1.4\times10^{3}$ kg/m$^3$ = volume density
0.3—Poisson's ratio
$3.46\times10^{9}$ N/m$^2$ = modulus of elasticity A metalized Mylar ring member was adhesively secured by contact cement to the uniform Mylar membrane to form a compound drumhead. The physical consistence of the ring member were as follows:

$1.73\times10^{-4}$ m = thickness
0.083 m = inner radius
0.165 m = outer radius
$1.30\times10^{3}$ kg/m$^3$ = volume density
0.3—Poisson's ratio
$1.93\times10^{9}$ N/m$^2$ = modulus of elasticity The compound drumhead was mounted on the Ludwig tom-tom and a uniform tension applied at six points uniformly spaced around the circumference of the drum. The tension was adjusted to a constant value and the drum was deflected by applying an effective mass ($m_e$) so as to effect a static displacement (y) at the center of the uniform membrane.

Figure 6:
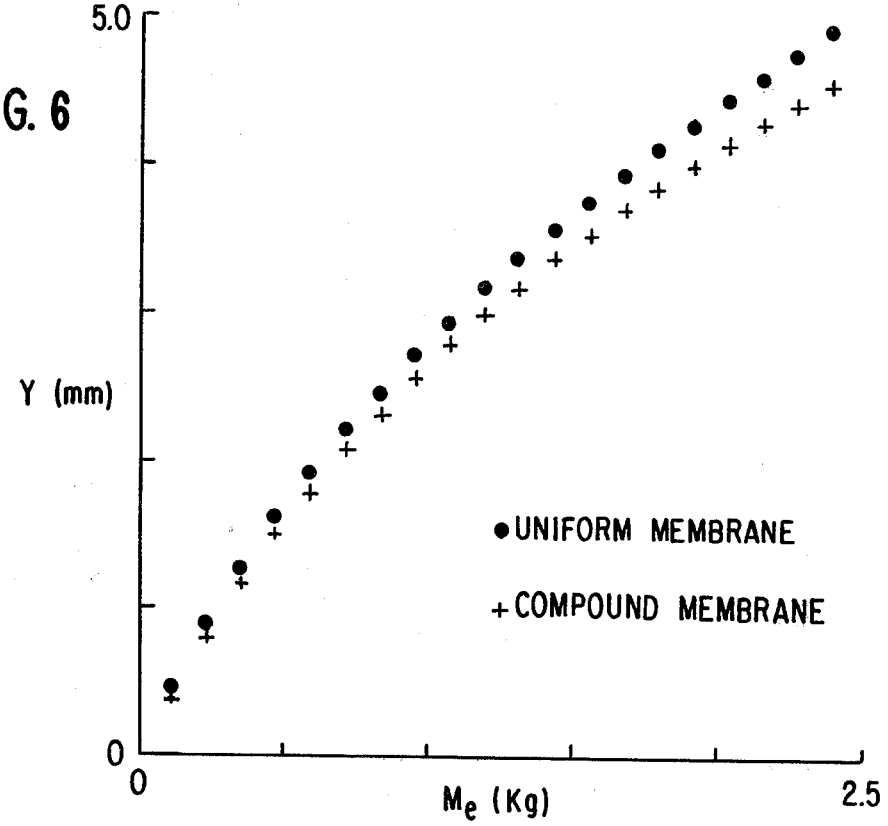
FIG. 6 is a graph of the static deflection produced in the compound drumhead of FIG. 1 and a uniform drumhead by an applied effective mass.

A graph of the static deflection (y) versus the applied effective mass ($m_e$) for the drumhead of the foregoing Example having the ring member attached and also for the uniform drumhead (i.e. the said drumhead membrane with no ring member attached) is shown in FIG. 6. Each drumhead initially was under static tension ($T_h$) of 468 N/m. As the applied effective mass ($m_e$) is increased, the tension is increased in both drumheads. This is indicated by the decreasing slope in each curve. However, the slope of the curve for the compound drumhead decreases more rapidly than the slope for the plain drumhead, indicating a higher return force for the same amount of deflection. This indicates that for both membranes driven in the steady state at equal amplitudes, there is a higher return force acting in the compound drumhead hence, a larger increase in frequency is produced in the compound drumhead.

Figure 7:
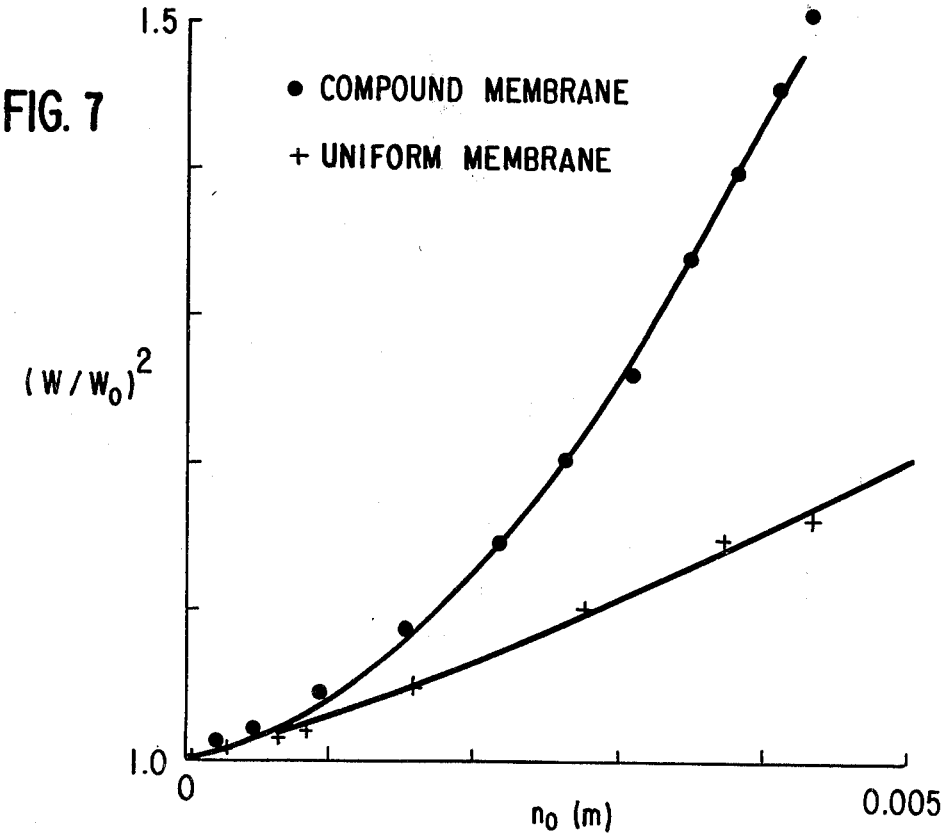
FIGS. 7, 8 and 9 show graphs of the ratio squared of the large amplitude resonance frequency to the small amplitude reasonance frequency of the compound drumhead of FIG. 1 and a uniform drumhead plotted against the resultant displacement at the center of the drumhead for the fundamental mode of the drum when the only difference is the initial tension applied to the drumhead.

FIG. 7 of the drawing shows the ratio squared of the large amplitude resonance frequency to the small amplitude resonance frequency $(\omega/\omega_o)^2$ of the compound drumhead of the Example plotted against the resultant amplitude ($\eta_o$) at the center of the drumhead for the fundamental mode of the drum where the initial tension on the drumhead (force per unit length of circumference) was 351 N/m. FIG. 7 also shows a plot of the results obtained when a drumhead having a uniform membrane identical to that used to form the compound drumhead of the Example was subjected to the same tests under the same tension.

Figure 8:
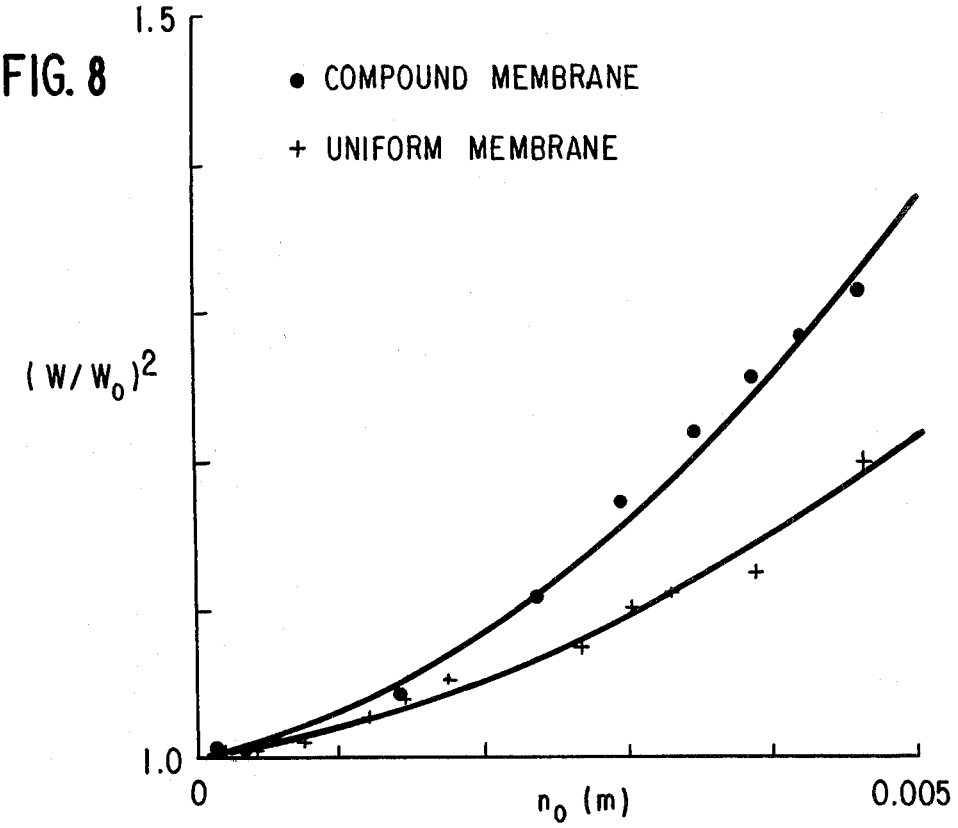
Figure 9:
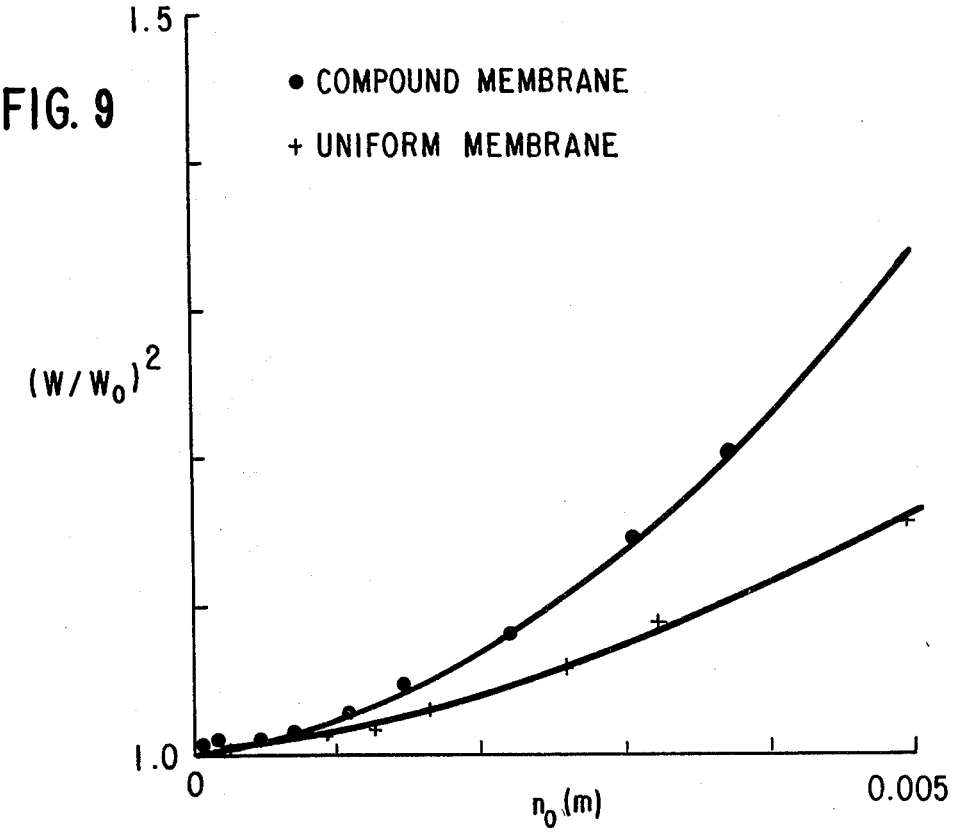

FIGS. 8 and 9 generally show the test results obtained when the same compound drumhead and uniform drumhead of FIG. 7 were subjected to the analysis as in FIG. 7 while under a tension of 468 N/m and 752 N/m, respectively.

The foregoing FIGS. 7, 8 and 9 show (1) that the compound drumhead membrane provides a greater increase in the resonance frequency or change of pitch when displaced as compared with that of a uniform membrane subjected to a like displacement, and (2) that there is a greater change in pitch effected when the tension applied to the compound membrane is relatively low.

In the disclosure and/or claims the term "compound" when used in conjunction with drumhead or membrane designates a drumhead or membrane having distinct portions or sections of different thickness and does not require that the drumhead have two separate parts which are combined to form the drumhead.

It should also be understood that the drumhead of the present invention can have the ring-like section or portion secured to or extending inwardly from the inner surface of the drumhead. The improved drumhead of the present invention can also be mounted on both ends of an open ended main body section of a drum.

I claim:

1. A drum structure comprising a generally cylindrical body section having mounted on at least one end thereof a drumhead comprising a generally circular drumhead membrane of durable flexible stretch-resistant material having a center circular portion of a predetermined average thickness comprising an area which is struck by drumsticks during normal play of the drum and an outer ring-like portion which extends appreciably over the surface of the drumhead membrane surrounding said area, said ring-like portion formed of flexible stretch resistant material together with said drumhead membrane providing an outer portion having a greater average thickness than the average thickness of said center portion and said outer portion forming with said center portion a continuous unitary drumhead membrane structure; whereby a large momentary increase in the pitch of the drum is effected when said center portion of the drumhead membrane is struck a sharp blow with a drum stick and simultaneously decreasing the decay time in which the drumhead membrane returns to rest after being struck a sharp blow compared with a uniformly thick drumhead membrane of said predetermined average thickness.

2. A drum structure as in claim 1, wherein said outer portion has a maximum width less than the radius of said drumhead.

3. A drum structure as in claim 1, wherein said outer portion has a substantially uniform thickness greater than the thickness of said center portion.

4. A drum structure as in claim 1, wherein said outer portion gradually increases in thickness as the distance from the center of said drumhead membrane increases.

5. A drum structure as in claim 1, wherein said outer portion has substantially the same thickness at points equally distant from the center of said drumhead membrane.

6. A drum structure as in claim 1, wherein said center portion has a generally circular configuration and a substantially uniform thickness and said outer portion has a ring-like configuration disposed concentrically with said center portion.

7. A drum structure as in claim 6, wherein said outer portion has a substantially uniform thickness.

8. A drum structure as in claim 6, wherein said outer portion gradually increases in thickness as the distance from the center of said drumhead membrane increases.

9. A drum structure as in claim 6, wherein said outer portion has substantially the same thickness at points equally distant from the center of said drumhead membrane.

10. A drum structure as in claim 6, wherein said outer portion is comprised of a ring-like section of substantially uniform thickness secured to a surface of said drumhead membrane.

11. A drum structure as in claim 10, wherein said ring-like section is adhesively secured to said drumhead membrane by means of a layer of flexible adhesive.

12. A drum structure as in claim 10, wherein said ring-like section is integral with said drumhead membrane.

13. A drum structure as in claim 10, wherein said ring-like section is adhesively secured to the outer surface of said drumhead membrane.

14. A drum structure as in claim 10, wherein said ring-like section has a width approximately half the radius of said drumhead membrane and extends inwardly from about the outer edge of said drumhead.

15. A drum structure as in claim 10, wherein said ring-like section has a substantially uniformly thickness ranging between about 0.0001 m to about 0.0005 m.

16. A drum structure as in claim 10, wherein said ring-like section has a substantially uniform thickness equal to about the thickness of said center portion of said drumhead membrane.

17. A drum structure as in claim 1, whereby said outer portion extends from the outer edge of said center portion outwardly to at least about the edge of said drumhead.

18. A drum structure as in claim 1, wherein said outer portion has a width approximately half the radius of said drumhead membrane and extends inwardly from about the outer edge of said drumhead.

19. A drum structure as in claim 1, wherein said center portion and said outer portion of said drumhead membrane are comprised of polyethylene terephthalate resin.

20. A drumhead adapted for mounting on a generally cylindrical drum body section comprising a generally circular drumhead membrane of durable flexible stretch-resistant material having a center circular portion of predetermined average thickness comprising the area which is struck by drumsticks during normal play of the drum and an outer ring-like portion which extends appreciably over the surface of the drumhead membrane surrounding said area, said ring-like portion formed of flexible stretch resistant material together with said drumhead membrane providing an outer portion having a greater average thickness than the average thickness of said center portion and forming with said center portion a continuous unitary drumhead membrane structure.

21. A drumhead as in claim 20, wherein said outer portion has a maximum width less than the radius of said drumhead.

22. A drumhead as in claim 20, wherein said outer portion has a substantially uniform thickness greater than the thickness of said center portion.

23. A drumhead as in claim 20, wherein said outer portion gradually increases in thickness as the distance from the center of said drumhead membrane increases.

24. A drumhead as in claim 20, wherein said outer portion has substantially the same thickness at points equally distant from the center of said drumhead membrane.

25. A drumhead as in claim 20, wherein said outer portion extends from the outer edge of said center portion outwardly to at least about the edge of said drumhead.

26. A drumhead as in claim 20, wherein said outer portion has a width approximately half the radius of said drumhead membrane and extends inwardly from about the outer edge of said drumhead.

27. A drumhead as in claim 20, wherein said center and outer portions of said drumhead membrane are comprised of polyethylene terephthalate resin.

28. A drumhead as in claim 20, wherein said center portion has a generally circular configuration and a substantially uniform thickness and said outer portion has a ring-like configuration disposed concentrically with said center portion.

29. A drumhead as in claim 28, wherein said outer portion has a substantially uniform thickness.

30. A drumhead as in claim 28, wherein said outer portion gradually increases in thickness as the distance from the center of said drumhead membrane increases.

31. A drumhead as in claim 28, wherein said outer portion has substantially the same thickness at points equally distant from the center of said drumhead membrane.

32. A drumhead as in claim 28, wherein said outer portion is comprised of a ring-like section of substantially uniform thickness secured to a surface of said drumhead membrane.

33. A drumhead as in claim 32, wherein said ring-like section is adhesively secured to said drumhead membrane.

34. A drumhead as in claim 32, wherein said ring-like section is integral with said drumhead membrane.

35. A drumhead as in claim 32, wherein said ring-like section is adhesively secured to the surface of said drumhead membrane by a layer of flexible adhesive.

36. A drumhead as in claim 32, wherein said ring-like structure has a substantially uniform thickness ranging between about 0.0001 m to 0.0005 m.

37. A drumhead as in claim 32, wherein said ring-like section has a substantially uniform thickness equal to about the thickness of said center portion of said drumhead membrane.

38. A drumhead as in claim 32, wherein said ring-like section is adhesively secured to the outer surface of said drumhead membrane.

* * * * *